United States Patent [19]

Eason

[11] Patent Number: 4,601,606

[45] Date of Patent: Jul. 22, 1986

[54] APPARATUS FOR LOADING AND STORING BOATS

[76] Inventor: Beatle Eason, P.O. Box 7323, Monroe, La. 71203

[21] Appl. No.: 677,791

[22] Filed: Dec. 4, 1984

[51] Int. Cl.[4] ..... B63B 35/52

[52] U.S. Cl. ..... 405/1; 114/263; 414/571

[58] Field of Search ..... 414/477–480, 414/494, 500, 538, 559, 571; 114/344, 263; 405/1, 2

[56] References Cited

U.S. PATENT DOCUMENTS 4,286,906 9/1981 Robertson ..... 414/477

4,507,016 3/1985 Honour ..... 114/344 X

*Primary Examiner*—Joseph E. Valenza

*Assistant Examiner*—Stuart J. Millman

*Attorney, Agent, or Firm*—Michael D. Carbo

[57] ABSTRACT

A boathouse loading device for loading a boat out of a body of water and into a boathouse, using in part the motive power of the boat. The device includes a pivotable, slidable carriage for receiving the hull of a boat, outriggers for stabilizing the boat during its movement, a tensionable latching mechanism for initially inhibiting movement of the carriage and a winch for sliding the carriage and for tensioning the latching mechanism.

4 Claims, 6 Drawing Figures

APPARATUS FOR LOADING AND STORING BOATS

BACKGROUND OF THE INVENTION

The present invention relates to loading and storage of boats in boathouses and, more particularly, to an apparatus for use with a boathouse for loading a boat from a body of water into the interior of the boathouse for storage therein.

Storing a boat, particularly a small pleasure craft, in a safe and secure manner often requires that the boat be removed from the water and placed in a location sheltered from storms and tides. Periodically, a boat must be removed from the water to allow for maintenance of the exterior of the hull. Conventional boathouses for storing boats out of the water often have bulky hoisting mechanisms for lifting a boat vertically out of the water and placing it within a protective superstructure. Commonly, little or no use is made of the motive power of the boat to be stored to assist in removing a boat from the water. A boathouse that has no floor or bottom above the surface of the water in which it is placed cannot effectively use the motive power of a boat to assist in storing the boat within the boathouse. Moreover, boathouses that have no floor for supporting a boat in drydock require constant use of hoisting apparatus to maintain the boat above the water.

Boathouses that do have a floor or other bottom support structure must overcome two problems in order to be effective in storing boats and sheltering them from the elements. First, the boathouse superstructure must be capable of rising and falling with the variation of the surface level of the body of water in which it is located. Second, the position of the boathouse floor relative to surface level of the body of water should be relatively constant so that any apparatus for loading a boat into the boathouse can be utilized within some small angle of operation, thereby minimizing the forces required to drydock the boat within the boathouse.

Conventionally, mechanisms for hoisting a boat out of the water and storing the boat in drydock within a superstructure include sets of pulleys mounted on an overhead support system. The pulleys and overhead support system must be capable of accommodating the full dead weight of the boat to be stored in drydock. A small pleasure craft having a V-shaped bottom must be stored using overhead support lines unless the bottom support is shaped so that it accommodates the V-shaped bottom and resists the normal tipping action of the drydocked boat.

Accordingly, it is an object of the present invention to allow for the use of the motive power of a boat to assist in loading the boat out of the water and into a boathouse for security from weather and vandals.

Another object of this invention is to reduce the hoisting forces required to load a boat out of the water and into a boathouse.

Yet another object of this invention is to alleviate the necessity of using external power other than a small winch or other loading or holding mechanism.

Still another object of the present invention is to minimize the difficulty of loading a boat out of the water and into a boathouse by the use of a new loading mechanism.

Another object of this invention is to allow for loading and unloading of a boat into and out of a floating boathouse situated on guide poles by means of slip rings.

Yet another object is to allow a single person to load and unload a boat in reduced time.

Additional objects and advantages of the invention are set forth in part in the description which follows, and in part are obvious from the description or may be learned by practice of the invention. The objects and advantages of the invention may be realized and obtained by means of the articles and apparatus particularly pointed out in the appended claims.

To achieve the foregoing objects, and in accordance with the purposes of the invention as broadly described herein, the boathouse loading device of the present invention for loading a boat out of a body of water and into a boathouse, using in part the motive power of the boat, comprises (1) a carriage adapted for receiving the hull of a boat, the carriage being pivotable about a horizontal axis located near an edge of the floor of the boathouse to allow an end of the carriage to dip below the surface of the water, the carriage being slidable forward and backward along a line perpendicular to the horizontal axis, and the carriage comprising (a) a channel frame, (b) a plurality of rollers spaced along the channel frame between the sides of the channel and adapted for rolling the hull of a boat over the channel frame, (c) outriggers, comprising outrigger guides, outrigger supports, and outrigger rollers, the said outriggers being attached to the channel frame for stabilizing a boat rolled onto the channel frame and for stabilizing the channel frame on the floor of the boathouse, (d) a tensionable, counterweighted latching mechanism for latching the channel frame to inhibit forward sliding of the channel frame, and capable of being unlatched by backward sliding of the channel frame, (e) tensionable rods for providing lateral support to the channel frame to inhibit lateral movement of the channel frame, (2) a plurality of guide rollers for slidably guiding the channel frame forward and backward along a line perpendicular to the horizontal axis, and (3) a winch for sliding the channel frame along the guide rollers and for tensioning the latching mechanism into a latched configuration. Preferably, the latching mechanism includes a counterweighted latch member pivotably attached to the channel frame, capable of being aligned with a stop and tensionably engageable with the stop, and also capable of being disengaged from and moved out of alignment with the stop.

BRIEF DESCRIPTION OF THE DRAWINGS

A greater appreciation of the objects and advantages of the invention may be understood by the below set forth detailed description taken in conjunction with the drawings, wherein.

DETAILED DESCRIPTION OF THE INVENTION

Figure 1:
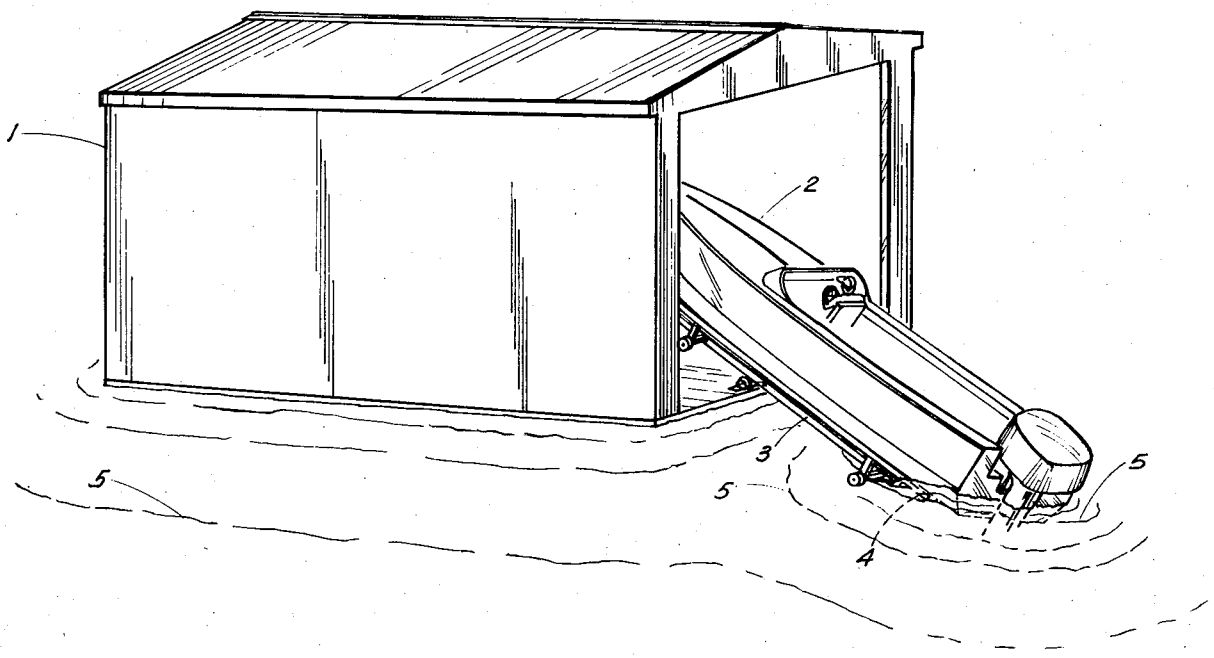
FIG. 1 is a perspective view of a boathouse with a boat being loaded by means of an illustrative embodiment of the loading apparatus according to the invention.

FIG. 1 shows a floating boathouse 1 and a boat 2 being loaded into the boathouse from a body of water by means of an illustrative embodiment of loading apparatus 3. End portion 4 of loading apparatus 3 is placed near to and above the surface 5 of the water and boat 2 is driven under its own motive power onto loading apparatus 3 thereby forcing end portion 4 below surface 5 of the body of water. In an alternative configuration, portion 4 of loading apparatus 3 is submerged below the surface 5 of the body of water. This configuration allows boat 2 to be driven under its own motive power onto loading apparatus 3.

Figure 2:
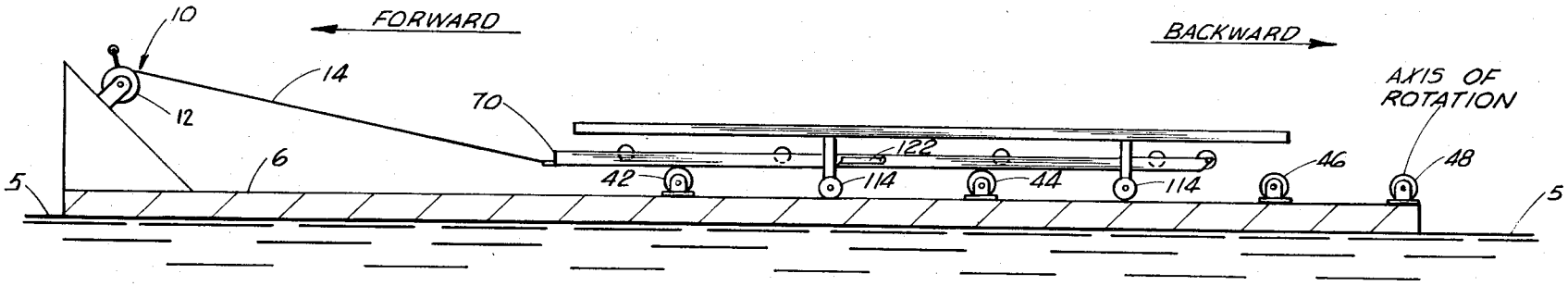
FIG. 2 is a side view of an illustrative embodiment of the loading apparatus according to the invention.

FIG. 2 shows a side view of a portion of boathouse 1 with the sides and top removed and with an illustrative embodiment of a loading apparatus according to the invention. Boathouse 1 includes floor 6 which floats to maintain its relative height above the surface 5 of the water. The loading apparatus includes winch 10, guiding means comprising a plurality of guide rollers 42, 44, 46 and 48 and carriage 70.

Winch 10 includes winch body 12 mounted to the boathouse forward of carriage 70 and also includes winch line 14 connecting winch body 12 to a forward portion of carriage 70. Winch 10 provides force communicated to carriage 70 through winch line 14 sufficient to slide carriage 70 forward along guide rollers 42, 44, 46 and 48, to a final resting place completely within the boathouse. Winch 10 also provides force sufficient to prevent carriage 70 from sliding completely off of the backward-most guide roller 48 when the center of gravity of carriage 70 is backward of the backward-most guide roller 48 during a portion of a boat loading operation.

The guiding means includes a plurality of guide rollers 42, 44, 46 and 48 mounted on floor 6. Guide roller 48 provides an axis of rotation for carriage 70 such that when the center of gravity of carriage 70 is located backward of guide roller 48, carriage 70 rotates and its backward-most end portion moves toward and can be submerged below surface 5 of the water. Guide roller 48 is adapted to engage a latching mechanism.

Figure 3:
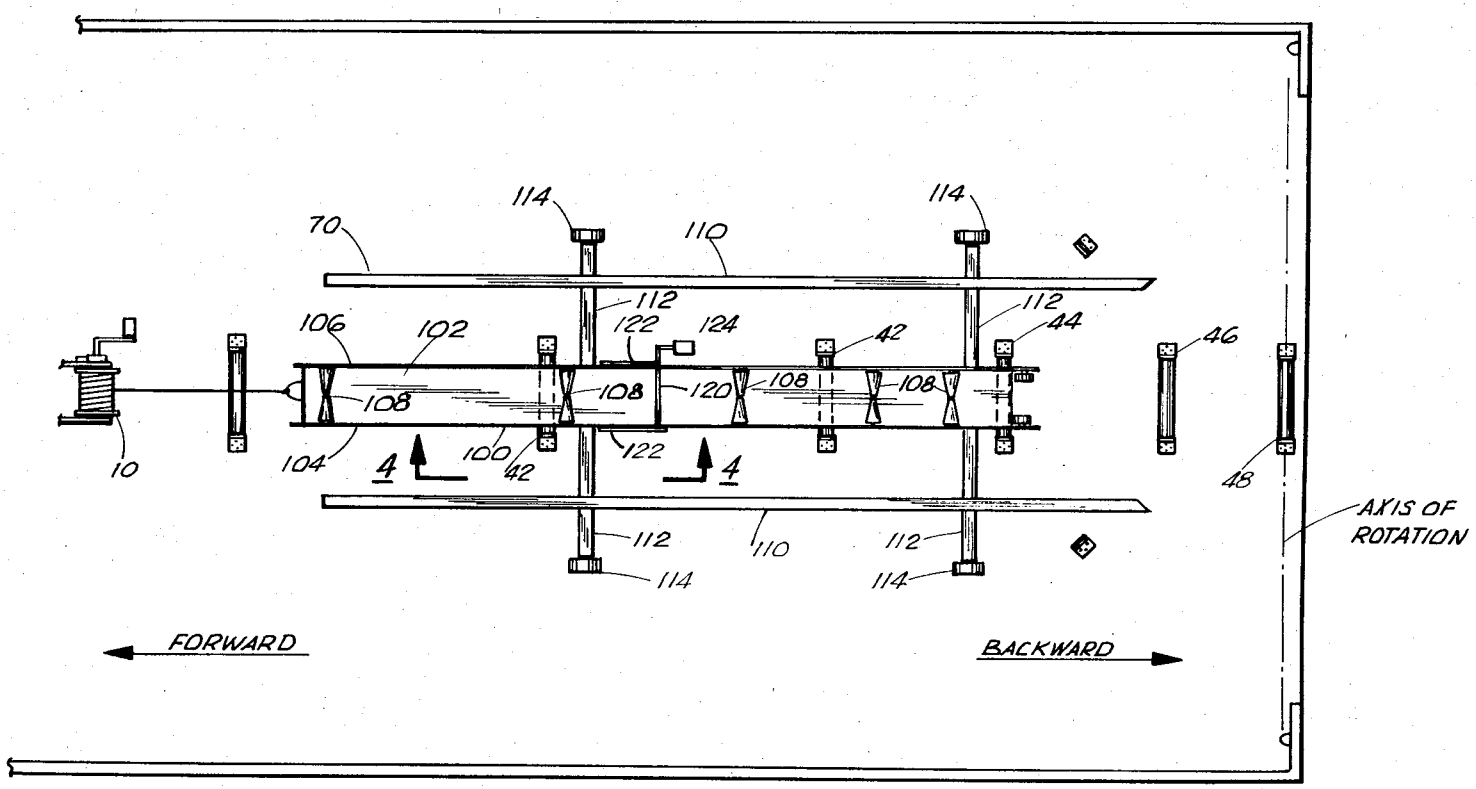
FIG. 3 is a plan view of an illustrative embodiment of the loading apparatus according to the invention.

FIG. 3 shows a plan view of an embodiment of loading apparatus 3 and includes winch 10, guide rollers 42, 44, 46 and 48, and carriage 70. Carriage 70 includes channel frame 100 having bottom 102 and sides 104 and 106. Mounted between and rotatably attached to sides 104 and 106 are a plurality of rollers 108 spaced along the longitudinal length of channel frame 100. Rollers 108 allow a boat to roll onto channel frame 100. Preferably, rollers 108 are shaped such that the diameter increases linearly from the center to each end, thereby allowing a V-shaped hull to be guided longitudinally along channel frame 100 as the hull rolls across rollers 108.

Outrigger guides 110 are attached to channel frame 100 by adjustable outrigger supports 112. Outrigger guides 110 inhibit a boat, rolled onto rollers 108, from tipping over to port or starboard during loading and unloading operations, and during storage. Outrigger supports 112 include stabilizer rollers 114 to inhibit the weight of a boat being loaded from tipping channel frame 100 about its longitudinal axis. Also outrigger rollers 114 allow supported channel frame 100 to roll forward and backward. Alternatively, outrigger guides 110 can have rollers mounted thereon in addition to or in lieu of guide rollers 108.

A latching mechanism is pivotally attached to carriage 70. Preferably, the latching mechanism includes stem 120, latch members 122 and counterweight 124. When latch members 122 are engaged under tension against guide roller 48, channel frame 100 is prevented from moving horizontally forward.

Figure 4A:
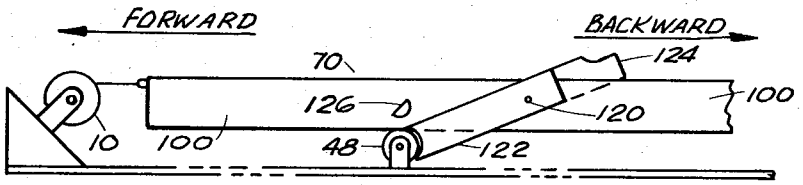
FIGS. 4(*a*) and 4(*b*) show two side views of a portion of an embodiment of latching mechanism according to the invention, FIG. 4(*a*) showing the latching mechanism in a latched configuration and FIG. 4(*b*) showing the latching mechanism in an unlatched configuration.
Figure 4B:
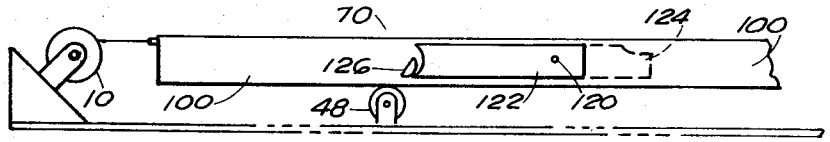

FIG. 4 shows a side view of a portion of an embodiment of a latching mechanism according to the invention. As shown in FIG. 4(*a*), to engage latch member 122 to guide roller 48, channel frame 100 is moved longitudinally forward. Winch 10 provides tensioning force through winch line 14 to channel frame 100 to tensionably engage latch member 122 to guide roller 48. In a preferred embodiment, there are two latch members 122, one located on each side of channel frame 100. To disengage latch member 122 from guide roller 48, channel frame 100 is slid longitudinally backward over guide rollers 42 through 48 until latch member 122 disengages from guide roller 48. Counterweight 124 drops under its own weight and communicates its motion through stem 120 to latch member 122, causing latch member 122 to pivot and raising latch member 122 clear of guide roller 48, as shown in FIG. 4(*b*). Carriage 70 is then free to be moved longitudinally forward along guide rollers 42 through 48 by applying force to the carriage, preferably by winching in winch 10. Latch stop 126, attached to side 104 of channel frame 100, acts to stop the movement of latch member 122 when it reaches a desired position clear of guide roller 48.

Figure 5:
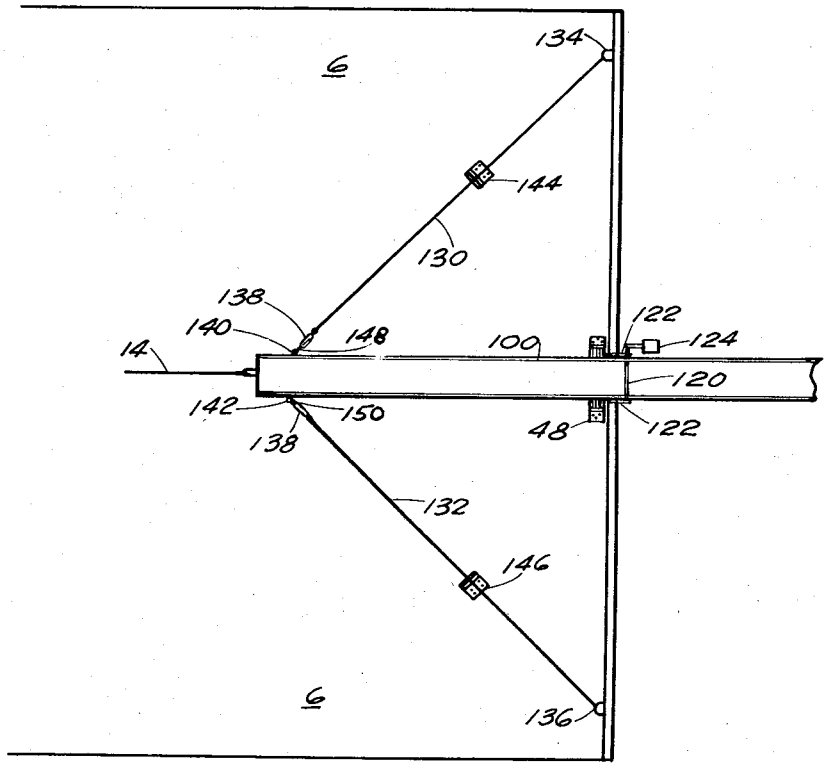
FIG. 5 is a plan view showing tensioning components of an embodiment of a releasing mechanism according to the invention.

In a preferred embodiment of the invention, a stabilizer rod having a release mechanism is provided as illustrated in FIG. 5. Each one of two adjustable stabilizer rods 130 and 132 is attached at one end 134 and 136, respectively, to floor 6 on opposite sides of a line forming the axis of rotation of guide roller 48, and are attached by hooks 138 into eye bolts 140 and 142, respectively, at a forward part of channel frame 100, as shown in FIG. 5. Compressible wedges 144 and 146 are located between floor 6 and stabilizer rods 130 and 132, respectively, to provide tension to stabilizer rods 130 and 132 and to create a spring-like effect to release rods 130 and 132 from channel frame 100 simultaneously with the disengaging of latch member 122 from guide roller 48 when carriage 70 is moved longitudinally backward after the center of gravity of a boat and carriage combination has moved forward of guide roller 48. Latch member 122 thus disengages from and rotates clear of guide roller 48. Stabilizer rods 130 and 132 are adjustable by means of turnbuckles 148 and 150, respectively, to adjust the length of rods 130 and 132 to achieve the proper tension to prevent forward and lateral movement carriage 70. After carriage frame 70 has rotated to the horizontal, latch member 122 and stabilizer rods 130 and 132 are simultaneously disengaged and released on backward motion of carriage 70.

To accomplish the loading of a boat into a boathouse by means of the apparatus according to the present invention, the winch line is winched in to a pre-set mark or to an appropriate tension and the winch is set. At this point the carriage is slightly forward of the position for engagement of the latching member to the backward-most guide roller. The carriage is pushed backward and the latch member is engaged by lifting the counterweight, releasing the carriage and allowing the pre-set tension to cause the latch member to be held in engagement against the guide roller. The stabilizer rods are placed into engagement with the channel frame and the tension on the winch line and on the stabilizer rods is increased to secure the boat carriage against forward and lateral movement.

At this point, a boat can be propelled under its own motive power to ride over the rollers on the backward-most portion of the channel frame and longitudinally along the rollers onto the entire channel frame. As the boat moves forward onto the channel frame, the carriage is first rotated out of horizontal. Then as the center of gravity of the boat and carriage combination passes forward of the backward-most guide roller, the carriage rotates back to horizontal and slides slightly forward of the axis of rotation passing through the backward-most guide roller. A slight backward movement of the carriage results in the unlatching of the latch member and simultaneously the release of the stabilizer rods. Winching the carriage forward causes the boat to move into position for storage. A carriage stop can be provided to stop forward movement when the carriage reaches a desired position within the boathouse.

It will be apparent to those skilled in the art that modifications and variations can be made in the loading apparatus of this invention. The invention in its broader aspects is not limited to the specific details and illustrative examples shown and described. Accordingly, departure may be made from such details without departing from the spirit or scope of applicant's general inventive concept.

What is claimed is:

1. An apparatus for loading a boat from a body of water into a boathouse having a floor above the surface of the body of water, said apparatus comprising:

(i) carriage means adapted for receiving the hull of a boat, the said carriage means being pivotable about a horizontal axis of rotation and being slidable forward and backward along a line perpendicular to the horizontal axis of rotation, and the said carriage means having:

(a) a channel frame having a bottom surface and two side surfaces, (b) roller means adapted for rollably receiving the hull of a boat over the bottom surface of the channel frame, (c) outrigger means attached to the side surfaces of the channel frame and adapted for stabilizing a boat rolled onto the channel frame and for stabilizing the channel frame on the floor of a boathouse, (d) tensionable latching means for latching the channel frame to inhibit forward sliding of said channel frame, the said latching means being unlatchable by backward sliding of said channel frame, (e) tensioning means for inhibiting forward and lateral sliding of said channel frame, the said tensioning means being releasable by backward sliding of the said channel frame, said tensioning means being releasable simultaneously with unlatching of said tensionable latching means;

(ii) guiding means for slidably receiving the channel frame along a line perpendicular to the horizontal axis of rotation; and (iii) winching means for winching the channel frame forward and backward along the guiding means for tensioning the latching means and for selectively retaining the channel frame from backward movement.

2. The apparatus according to claim 1, wherein:

(i) the two side surfaces of the channel frame are substantially perpendicular to the bottom surface and each side surface is substantially parallel to the other side surface, and (ii) the roller means comprises a plurality of rollers spaced along the channel frame, each roller being rotatably attached to the two side surfaces of the channel frame.

3. The apparatus according to claim 1, wherein the tensionable latching means comprises:

(a) a counterweighted latching member pivotably attached to the channel frame, alignable to engage a stop member, and counterweighted to pivotally disalign the latching member when the latching member is unlatched from the stop member; and (b) means for releasing the tensioning means to allow the channel frame to slide backward and unlatch the latching member, thereby allowing the counterweight to pivot the latching member out of alignment.

4. The apparatus according to claim 2 wherein:

(a) the outrigger means comprises (i) a plurality of outrigger support members attached to the channel to the channel frame; (ii) at least two outrigger guide members, each guide member being attached to at least one outrigger support member and adapted to supportably receive a hull of a boat located on the channel frame; and (iii) a plurality of outrigger rollers, each roller being attached to a support member and adapted for rollably supporting the support member.

* * * * *